US010240336B2

(12) United States Patent
Van Cleve et al.

(10) Patent No.: US 10,240,336 B2
(45) Date of Patent: Mar. 26, 2019

(54) TRUSS ASSEMBLY WITH ALIGNMENT GUIDES

(71) Applicant: INTERSYSTEMS INTERNATIONAL INC, Omaha, NE (US)

(72) Inventors: Dustin Andrew Van Cleve, Elkhorn, NE (US); Theodore Leo Sondgeroth, Omaha, NE (US); Dennis C. Secord, Battle Creek, MI (US); Chris Jacob, Ankeny, IA (US)

(73) Assignee: Intersystems International Inc, Omaha, NE (US)

( * ) Notice: Subject to any disclaimer, the term of this patent is extended or adjusted under 35 U.S.C. 154(b) by 0 days.

(21) Appl. No.: 15/542,479

(22) PCT Filed: Jan. 11, 2016

(86) PCT No.: PCT/US2016/012860

§ 371 (c)(1),
(2) Date: Jul. 10, 2017

(87) PCT Pub. No.: WO2016/115037

PCT Pub. Date: Jul. 21, 2016

(65) Prior Publication Data

US 2018/0274224 A1 Sep. 27, 2018

Related U.S. Application Data

(60) Provisional application No. 62/102,469, filed on Jan. 12, 2015.

(51) Int. Cl.
*E04B 1/18* (2006.01)
*E04B 1/24* (2006.01)
(Continued)

(52) U.S. Cl.
CPC ..... *E04B 1/2403* (2013.01); *E04C 3/08* (2013.01); *E04H 12/10* (2013.01);
(Continued)

(58) Field of Classification Search
CPC ..... E04B 1/2403; E04B 2001/2406; E04B 2103/06; E04B 2001/2415; E04C 3/08; E04C 2003/0491; E04H 12/10
(Continued)

(56) References Cited

U.S. PATENT DOCUMENTS 3,123,185 A * 3/1964 Van Der Rijst .... A47B 96/1408 52/633
4,957,186 A * 9/1990 Reetz ..... E04C 3/08 248/284.1
(Continued)

FOREIGN PATENT DOCUMENTS

CA 2535970 A1 8/2007

OTHER PUBLICATIONS

European Patent Office, International Search Report for International Application No. PCT/US2016/012860, dated May 18, 2016.

*Primary Examiner* — Basil S Katcheves

(57) ABSTRACT

A truss assembly (12) has a plurality of structural members joined by a truss joint. The truss joint includes first (16) and second (18) structural members and a pair of shear plates (22). Each shear plate (22) includes at least one shear tab (24) having a curved alignment guide (40) formed by an elongated slot with an open end. An end of the second structural member (18) has a locating hole (42) proximate its mounting bolt hole. The truss assembly further includes an alignment/drift pin (44) used to position the second structural member (18) with respect to the shear plates (22). The alignment/drift pin (44) is configured to be inserted into the locating hole (42) and then maneuverable into the alignment
(Continued)

guide (40) to position the second structural member (18) so that mounting bolt holes in the shear plates (22) and a mounting bolt hole in the second structural member (18) align allowing insertion of a through bolt (30).

6 Claims, 5 Drawing Sheets

(51) Int. Cl.
*E04H 12/10* (2006.01)
*E04C 3/08* (2006.01)
*E04C 3/04* (2006.01)

(52) U.S. Cl.
CPC ..... *E04B 2001/2406* (2013.01); *E04B 2001/2415* (2013.01); *E04B 2103/06* (2013.01); *E04C 2003/0491* (2013.01); *E04C 2003/0495* (2013.01)

(58) Field of Classification Search
USPC ..... 52/633
See application file for complete search history.

(56) References Cited

U.S. PATENT DOCUMENTS

| | | | | |
|---|---|---|---|---|
| 6,047,504 | A * | 4/2000 | Dusenberry | E04B 1/2608 52/514 |
| 6,161,359 | A | 12/2000 | Ono | |
| 6,499,266 | B1 | 12/2002 | Macumber | |
| 7,703,615 | B2 * | 4/2010 | Willim | B66C 23/70 212/175 |
| 2005/0055969 | A1 * | 3/2005 | Simmons | E04B 1/24 52/831 |

* cited by examiner

TRUSS ASSEMBLY WITH ALIGNMENT GUIDES

RELATED APPLICATION

Under provisions of 35 U.S.C. § 119(e), Applicant claims the benefit of U.S. Provisional Application No. 62/102,469, entitled TRUSS ASSEMBLY WITH ALIGNMENT GUIDES and filed Jan. 12, 2015.

BACKGROUND OF THE INVENTION

Field of Invention

This invention relates to a truss assembly.

Description of Related Art

In the construction of trusses, various diagonal braces extend between and are attached to truss members. Usually, brackets are provided for attaching the diagonal braces to the truss members. Matching bolt holes in the ends of the diagonal braces and in the brackets are used to bolt the braces to the brackets and thus create the truss assembly.

One problem with typical truss assemblies is the requirement that different brackets be used for truss assemblies that have different longitudinal dimensions or different dimensions between the two truss members. Therefore, it is necessary to manufacture different brackets for each different dimension of truss assembly.

SUMMARY

The following brief summary is provided to indicate the nature of the subject matter disclosed herein. While certain aspects of the present invention are described below, the summary is not intended to limit the scope of the present invention.

A first aspect of the present invention is directed to a truss assembly formed with a plurality of structural members joined by at least one truss joint. The truss joint includes a first structural member and a second structural member having a first end, the first end being adjacent the first structural member, wherein the second structural member has a mounting bolt hole formed therein at the first end. The truss joint also has a pair of shear plates, each shear plate connected to the first structural member and positioned such that one of the pair of shear plates abuts a first side of the first end of the second structural member and the other of the pair of shear plates abuts an opposing second side of the first end of the second structural member. Each shear plate includes at least one shear tab, the shear tab having a mounting bolt hole formed therein. The truss joint also has a through bolt running through the mounting bolt holes in the shear plates and the mounting bolt hole in the second structural member. The at least one shear tab has a curved alignment guide formed by an elongated slot with an open end formed in the shear tab. The first end of the second structural member has a locating hole proximate the mounting bolt hole in the second structural member. The truss assembly further includes an alignment/drift pin used to position the second structural member with respect to the shear plates. The alignment/drift pin is configured to be inserted into the locating hole and then maneuverable into the alignment guide to position the second structural member so that the mounting bolt holes in the shear plates and the mounting bolt hole in the second structural member align allowing insertion of the through bolt. The alignment/drift pin may be removed from the locating hole and the alignment guide after the through bolt is inserted through the mounting bolt holes in the shear plates and the mounting bolt hole in the second structural member.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
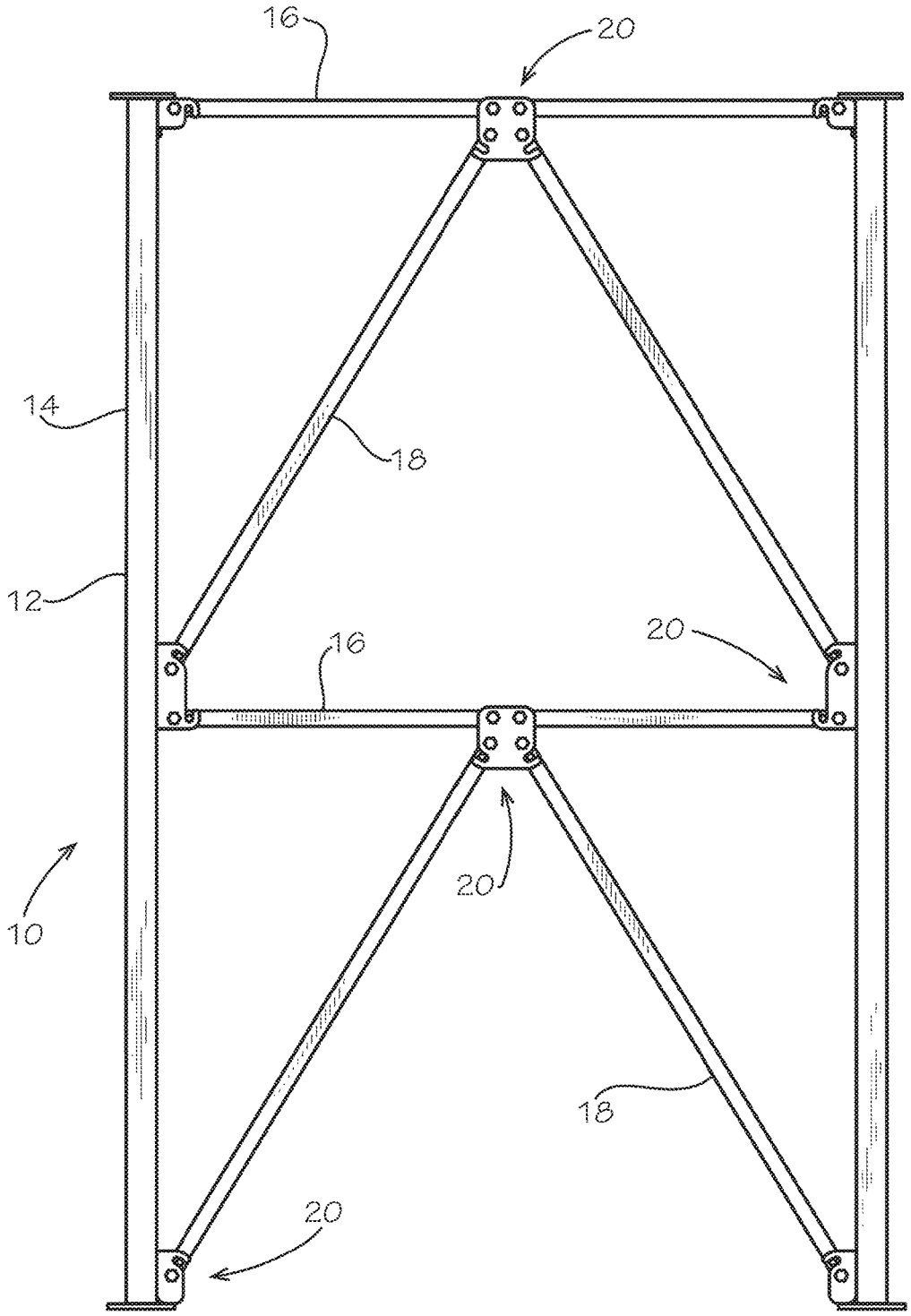
FIG. 1 is an elevation view of a tower with a truss assembly with a joint of the present invention.
Figure 2:
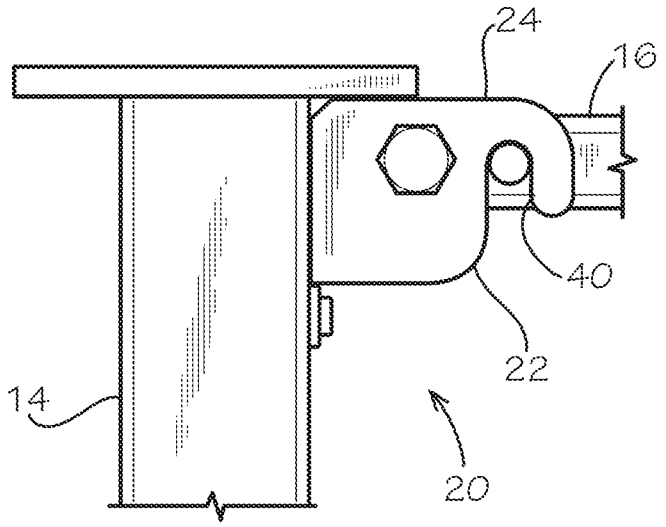
FIG. 2 is an enlarged view of a joint of the truss assembly of FIG. 1.

Referring to the figures, FIG. 1 illustrates a portion of a tower 10 comprising a truss assembly 12. The truss assembly 12 includes a plurality of structural members such as vertical truss members 14, horizontal struts 16 and diagonal braces 18, with the structural members 14, 16, 18 connecting in a tower configuration. Various truss joints 20 (shown in enlarged pictorial view in FIGS. 2-5) are provided to join adjacent truss members 14, struts 16 and braces 18 where they meet. Desirably, the truss members 14, struts 16 and braces 18 are of tubular construction.

Figure 3:
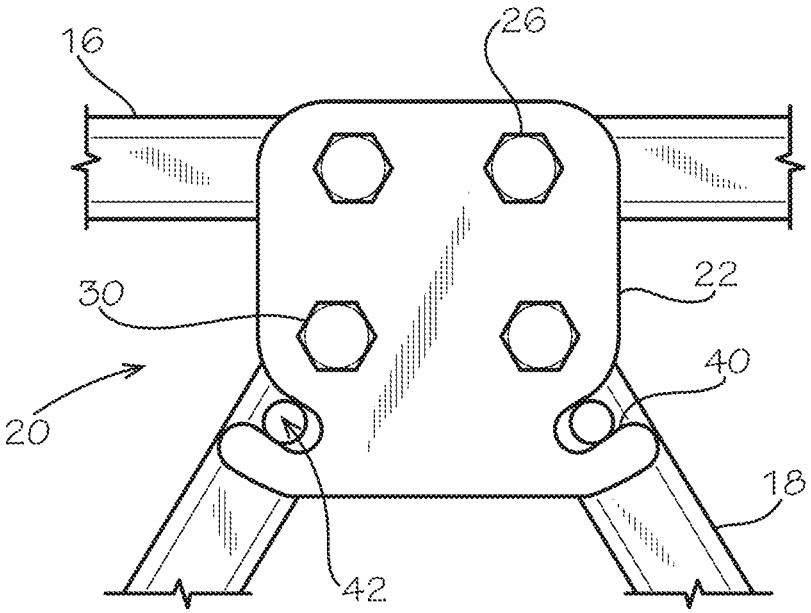
FIG. 3 is an enlarged view of another joint of the truss assembly of FIG. 1.
Figure 4:
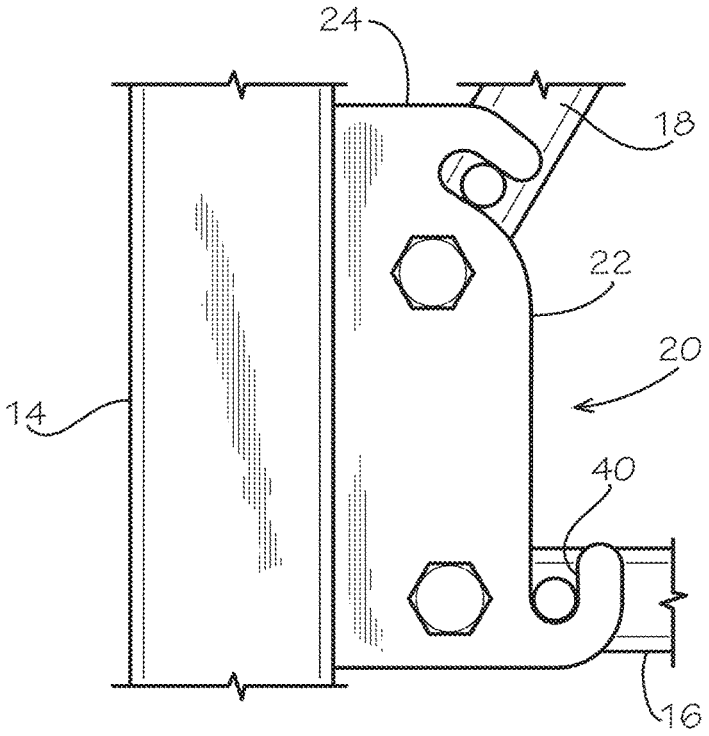
FIG. 4 is an enlarged view of another joint of the truss assembly of FIG. 1.
Figure 6:
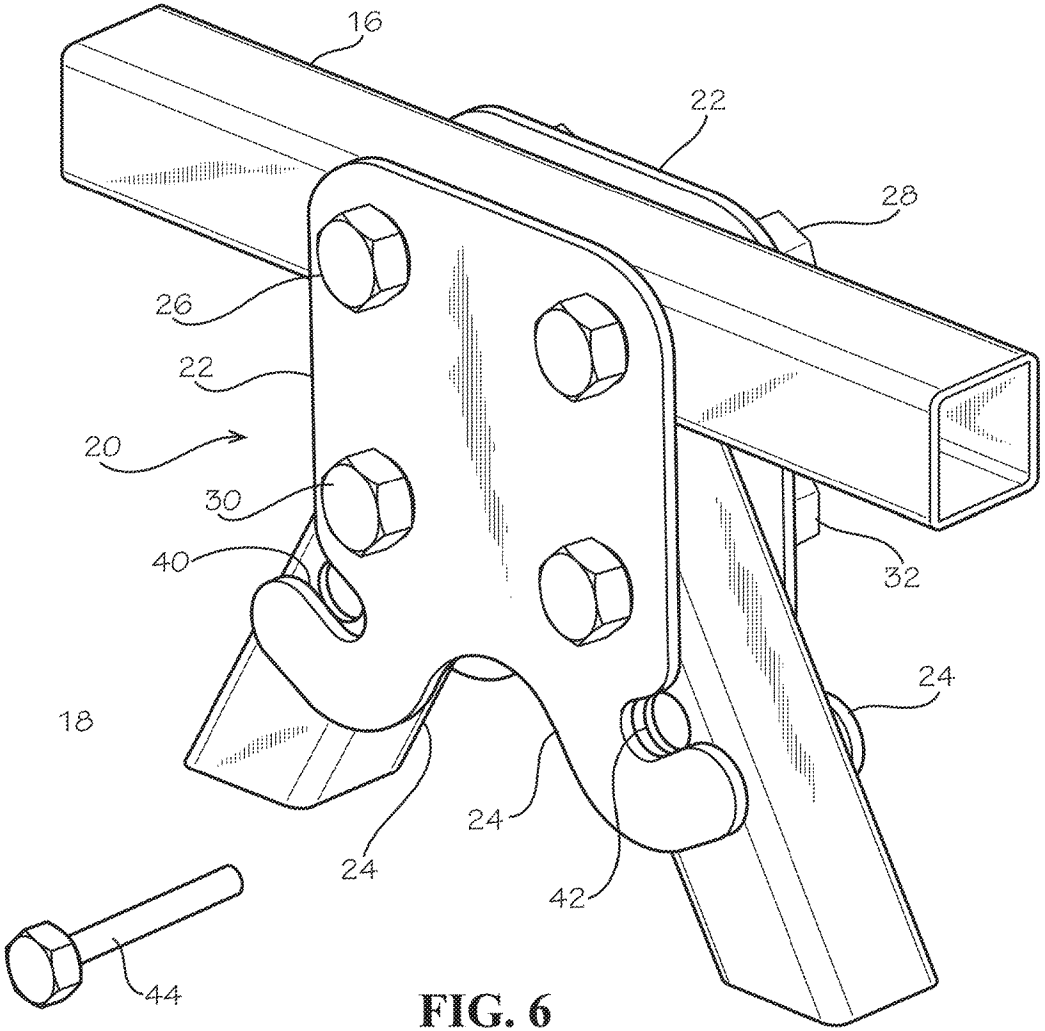
FIG. 6 is a perspective view of the joint of FIG. 3.
Figure 7:
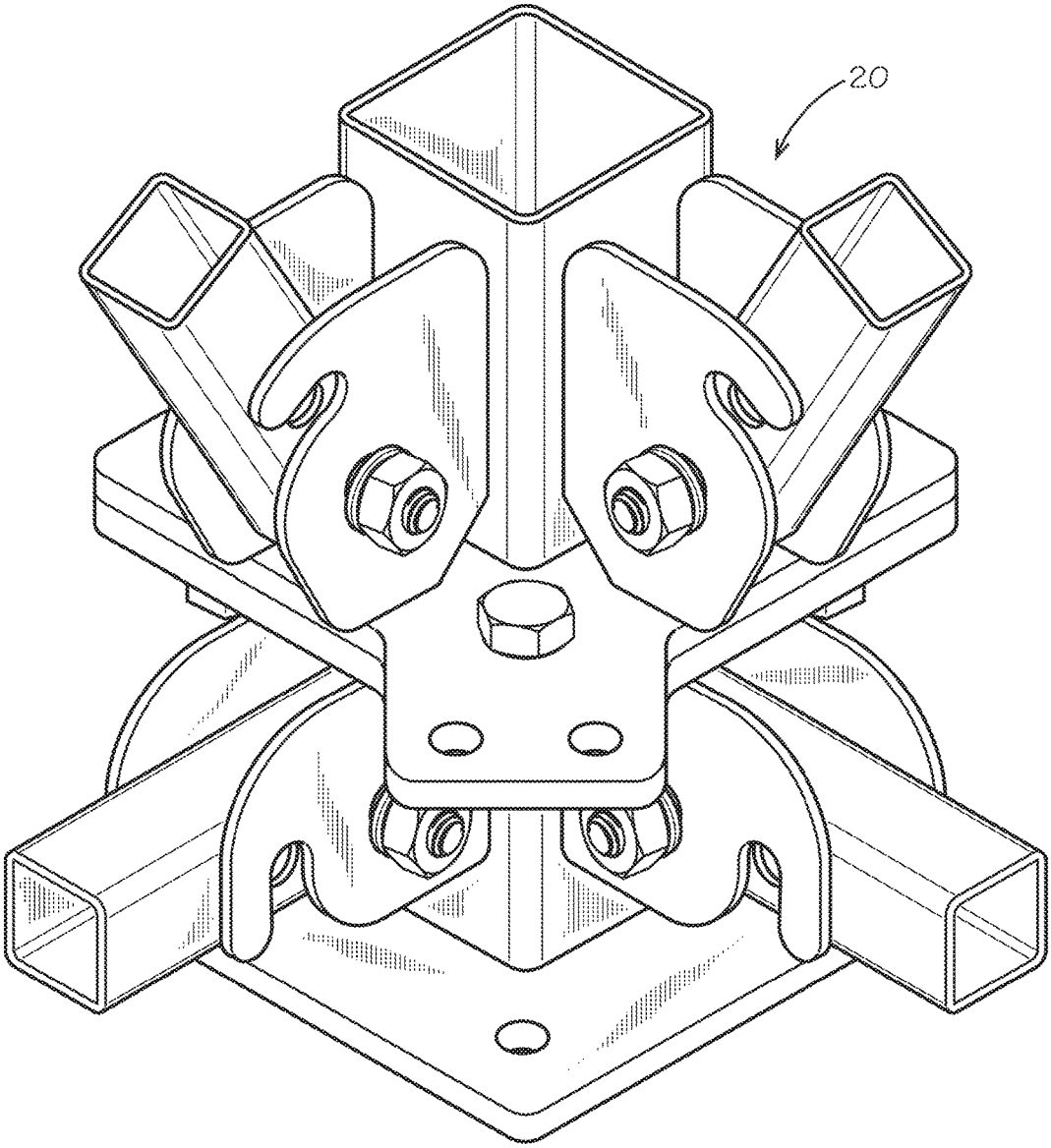
FIG. 7 is a perspective view of another joint of the truss assembly of FIG. 1.

As best seen in the embodiment of the truss joint 20 shown in FIGS. 3 and 6, the truss joint 20 has a pair of shear plates 22 located on either side of the structural members, in this case one strut 16 and a pair of braces 18. Each shear plate 22 has a pair of shear tabs 24 used to form a double shear tab connection between each brace 18 and the strut 16.

Figure 5:
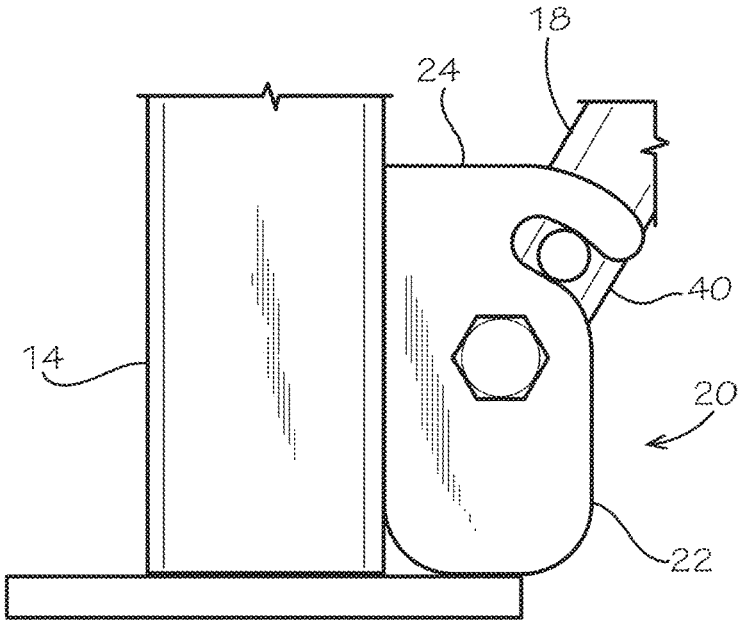
FIG. 5 is an enlarged view of another joint of the truss assembly of FIG. 1.

However, as can be seen in the embodiment of the truss joint 20 shown in FIG. 5 in which only a single brace 18 is connected to a vertical truss member 14, each shear plate 22 may only have a single shear tab 24. In the embodiment illustrated in FIG. 3, the shear plates 22 are connected to the strut 16 with a pair of mounting bolts 26 running through mounting holes 26A in the shear plates 22 and mounting holes 26B in the strut 16, and suitable nuts 28. However, other suitable connection hardware may be used using sound engineering judgment to mount the shear plates 22 to the structural member, strut 16. A single through bolt 30 running through mounting holes 30A in the shear plates 22 and mounting holes 30B in the brace 18 with corresponding nut 32 are used to connect each diagonal brace 18 with the shear tabs 24. Although the embodiment described with respect with the joint 20 shown in FIGS. 3 and 6 has two diagonal braces 18 joined with the horizontal strut 16, one skilled in the art will understand that the invention contemplates using the double shear tab, single bolt connection joint 20 in the various combinations of vertical truss members 14, horizontal strut members 16 and diagonal braces 18 depending on where the connection joint 20 is on the tower 10 as also shown in the embodiments illustrated in FIGS. 2, 4-5 and 7.

According to the invention, in the illustrated embodiment of FIG. 3, the shear tab 24 has a curved alignment guide 40 for each diagonal brace 18 to be connected to the shear plate 22. As perhaps best seen in FIG. 6, the alignment guide 40 is an open ended slot formed in the shear tab 24. Each diagonal brace 18 (or applicable structural member such as the horizontal strut 16 such as shown in the embodiment depicted in FIG. 4) has an additional unbolted locating hole 42 near the mounting bolt hole 30B in the brace 18. An alignment/drift pin 44 is inserted into the locating hole 42 and used to guide the brace 18 into the correct alignment so the through bolt 30 can to secure one end of the brace 18 to the shear tab 24. With the alignment/drift pin 44 inserted into the locating hole 42, the alignment/drift pin 44 is then maneuvered into the alignment guide 40 to position the brace 18 such that the mounting hole 30B in the brace 18 aligns with the mounting holes 30A in the shear tabs 24. With the mounting holes 30A, 30B aligned, the through bolt 30 may be inserted to make the connection. The same will be done on the other end of the brace 18 as perhaps shown in the embodiment of the joint 20 shown in FIG. 4, also allowing the alignment/drift pin 44 to help swing the diagonal brace 18 into the correct alignment.

The alignment guide 40 is registered with respect to the mounting bolt hole 30A in the shear tab 24 such that the arc formed by the alignment guide with permit the shear plate 22 to be used with structural members 14, 16, 18 that meet at various angles due to differing lengths of the structural members based on the size of the tower 10 needed for the desired application. The curved orientation and elongated length of the alignment guide 40 enables a single shear plate 22 to be used in towers 10 differing sizes and using structural members have differing lengths resulting in differing angles for the structural members 14, 16, 18 as they form the joint 20. Thus, one advantage of the present invention is that the connection with a single mounting bolt 30 and alignment guides 40 enables components to be used for a more universal assembly of truss assemblies 12 having different dimensions.

In one embodiment, the alignment guide 40 and the locating hole 42 are not used in the final bolted connection of the joint 20 itself, but are only used in combination with the temporary alignment/drift pin 44 as a means for positioning the members that form the joint 20 in the single bolted connection. Attempting to align bolt holes in a tubular structural member 14, 16 and 18 with the bolt holes in two facing shear plates 22 for insertion of the mounting bolt 30 can otherwise be a complicated matter. The alignment guides 40 allows the structural member to be swung into position and "constrained" as the final bolt hole alignments are made.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings.

The invention claimed is:

1. A truss assembly formed with a plurality of structural members joined by at least one truss joint, the truss joint comprising:

a first structural member;

a second structural member having a first end, said first end being adjacent the first structural member, wherein the second structural member has a second structural member mounting bolt hole formed therein at the first end;

a pair of shear plates, each shear plate connected to the first structural member and positioned such that one of said pair of shear plates abuts a first side of the first end of the second structural member and the other of said pair of shear plates abuts an opposing second side of the first end of the second structural member, wherein each shear plate comprises at least one shear tab, the shear tab having a shear plate mounting bolt hole formed therein;

a through bolt running through the shear plate mounting bolt holes in the shear plates and the second structural member mounting bolt hole in the second structural member;

wherein the at least one shear tab has a curved alignment guide comprising an elongated slot with an open end formed in the shear tab;

wherein the first end of the second structural member has a locating hole proximate the second structural member mounting bolt hole in said second structural member; and the truss assembly further comprising an alignment/drift pin used to position the second structural member with respect to the shear plates, wherein the alignment/drift pin is configured to be inserted into the locating hole and then maneuvered into the alignment guide to position the second structural member so that the shear plate mounting bolt holes in the shear plates and the second structural member mounting bolt hole in the second structural member align allowing insertion of the through bolt.

2. The truss assembly of claim 1 wherein the shear plates are connected to the first structural member with at least one mounting bolt running through aligned shear plate mounting holes in each of the shear plates and a first structural member mounting hole in the first structural member.

3. The truss assembly of claim 1 wherein the alignment/drift pin is not a load bearing component that transfers load between the second structural members and the shear plates.

4. The truss assembly of claim 1 wherein the alignment/drift pin is removed from the locating hole and the alignment guide after the through bolt is inserted through the shear plate mounting bolt holes in the shear plates and the second structural member mounting bolt hole in the second structural member.

5. The truss assembly of claim 1 wherein the joint connection consists of only a single through bolt connecting the second structural member to the pair of shear plates.

6. The truss assembly of claim 1 further comprising:

a third structural member having a first end, said first end being adjacent the first structural member, wherein the third structural member has a third structural member mounting bolt hole formed therein at the first end, wherein the each shear plate is further positioned such that one of said pair of shear plates abuts a first side of the first end of the third structural member and the other of said pair of shear plates abuts an opposing second side of the first end of the third structural member, wherein each shear plate comprises a first shear tab for said second structural member and a second shear tab for said third structural member, each shear tab having a shear plate mounting bolt hole formed therein;

a second through bolt running through the shear plate mounting bolt holes in the shear plates and the third structural member mounting bolt hole in the third structural member;

wherein each shear tab has a curved alignment guide comprising an elongated slot with an open end formed in the shear tab; and wherein the first end of the third structural member has a locating hole proximate the third structural member mounting bolt hole in said third structural member.

* * * * *